US010455644B2

(12) United States Patent
Takagi

(10) Patent No.: US 10,455,644 B2
(45) Date of Patent: Oct. 22, 2019

(54) FIXING DEVICE AND HEATER USED IN FIXING DEVICE

(71) Applicant: CANON KABUSHIKI KAISHA, Tokyo (JP)

(72) Inventor: Kenji Takagi, Odawara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 813 days.

(21) Appl. No.: 15/014,927

(22) Filed: Feb. 3, 2016

(65) Prior Publication Data

US 2016/0234882 A1 Aug. 11, 2016

(30) Foreign Application Priority Data

Feb. 6, 2015 (JP) ..... 2015-022676

(51) Int. Cl.
*H05B 3/22* (2006.01)
*G03G 15/20* (2006.01)

(52) U.S. Cl.
CPC ..... *H05B 3/22* (2013.01); *G03G 15/2053* (2013.01); *G03G 15/2042* (2013.01); *G03G 2215/2035* (2013.01); *H05B 2203/02* (2013.01)

(58) Field of Classification Search
CPC ..... G03G 15/2042; G03G 15/2053; G03G 2215/2035; H05B 2203/02; H05B 3/22
USPC ..... 219/216, 543, 522, 469, 548, 541; 399/328, 320, 321, 324, 325, 326, 331, 399/333, 69, 329, 330, 335; 492/46, 56; 338/305, 306–314, 322, 325, 333
See application file for complete search history.

(56) References Cited

U.S. PATENT DOCUMENTS 7,283,145 B2 * 10/2007 Kato ..... B41J 11/002 219/216
2003/0196999 A1 * 10/2003 Kato ..... H05B 3/0095 219/216
2009/0230114 A1 * 9/2009 Taniguchi ..... G03G 15/2042 219/216
2014/0027441 A1 * 1/2014 Mine ..... H05B 3/02 219/538

FOREIGN PATENT DOCUMENTS

JP 2007025474 A 2/2007
JP 2012-189808 A 10/2012
JP 2014-139660 A 7/2014

* cited by examiner

*Primary Examiner* — Dana Ross
*Assistant Examiner* — Ket D Dang
(74) *Attorney, Agent, or Firm* — Canon USA, Inc., IP Division

(57) ABSTRACT

A heater used in a fixing device includes a substrate, a first heat generation resistor, a second heat generation resistor with a gap to the first heat generation resistor in the longitudinal direction, a first conductive pattern, a second conductive pattern, and the third conductive pattern, wherein a width of at least one of the first and second heat generation resistors in the transverse direction in a first area adjacent to the gap is smaller than the width in a second area, arranged adjacent to the first area, farther from the gap in the longitudinal direction than the first area.

10 Claims, 14 Drawing Sheets

FIXING DEVICE AND HEATER USED IN FIXING DEVICE

BACKGROUND OF THE INVENTION

Field of the Invention

The present invention relates to a fixing device included in an image forming apparatus such as an electrophotographic copying machine and printer, and a heater used in the fixing device.

Description of the Related Art

As a fixing device included in an image forming apparatus such as a copying machine and a laser beam printer, one using a film is known. Such a fixing device typically includes a cylindrical film, a plate-shaped heater which makes contact with an inner surface of the film, and a pressure member which forms a nip portion with the heater via the film. The fixing device performs fixing processing at the nip portion while conveying and heating a recording material having a toner image formed thereon to fix the toner image to the recording material.

The fixing device uses a film having a low heat capacity. The fixing device thus has an advantage of a short warm-up time, which contributes to reduced first print out time (FPOT) of the image forming apparatus. However, if small-sized sheets are continuously printed, a phenomenon in which an area of the nip portion where the recording materials do not pass rises in temperature, or a temperature rise of a non-sheet passing are, is likely to occur.

As a technique for suppressing the temperature rise of the non-sheet passing area, there is known a heater including a substrate on which a heat generation resistor having a positive resistance-temperature characteristic (positive temperature coefficient (PTC) characteristic) is formed. If a current is applied to a heat generation resistor having a high PTC characteristic in a conveyance direction of a recording material, the resistance of a sheet non-passing portion that rises in temperature increases. This can reduce the current flowing through the heat generation resistor and then reduce the amount of heat generation in the sheet non-passing portion, thereby suppressing the temperature rise of the non-sheet passing area.

The heat generation resistor is made of a paste material. Since paste materials having a high PTC characteristic have low sheet resistance, the amount of heat generation needed for the heater used in the fixing device may be difficult to obtain. Japanese Patent Application Laid-Open No. 2012-189808 discusses a heater that includes a plurality of longitudinally-divided conductive patterns connected to a heat generation resistor along a longitudinal direction. Such a heater can provide a total resistance needed for the heater used in the fixing device while using a paste material having a low sheet resistance.

However, the heater discussed in Japanese Patent Application Laid-Open No. 2012-189808 has a problem that the amount of heat generation drops locally in an area corresponding to a gap between the conductive patterns of the heater, possibly causing temperature variations of the heater in the longitudinal direction.

SUMMARY OF THE INVENTION

According to an aspect of the present invention, a heater used in a fixing device includes an elongated substrate, a first heat generation resistor formed on the substrate, and a second heat generation resistor formed on the substrate, next to the first heat generation resistor in a longitudinal direction of the substrate, the first heat generation and the second heat generation being arranged with a gap therebetween in the longitudinal direction. The heater further includes a first conductive pattern connected, along the longitudinal direction, to each one end of the first and second heat generation resistors in a transverse direction of the substrate, a second conductive pattern formed in an area of the substrate on a side opposite to the first conductive pattern in the transverse direction across the first heat generation resistor and connected to the first heat generation resistor along the longitudinal direction, the second conductive pattern not being connected to the second heat generation resistor, and a third conductive pattern formed in an area of the substrate on a side opposite to the first conductive pattern in the transverse direction across the second heat generation resistor and connected to the second heat generation resistor along the longitudinal direction, the third conductive pattern not being connected to the second conductive pattern or the first heat generation resistor, wherein a width of at least one of the first and second heat generation resistors in the transverse direction in a first area adjacent to the gap is smaller than the width in a second area, arranged adjacent to the first area, farther from the gap in the longitudinal direction than the first area.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
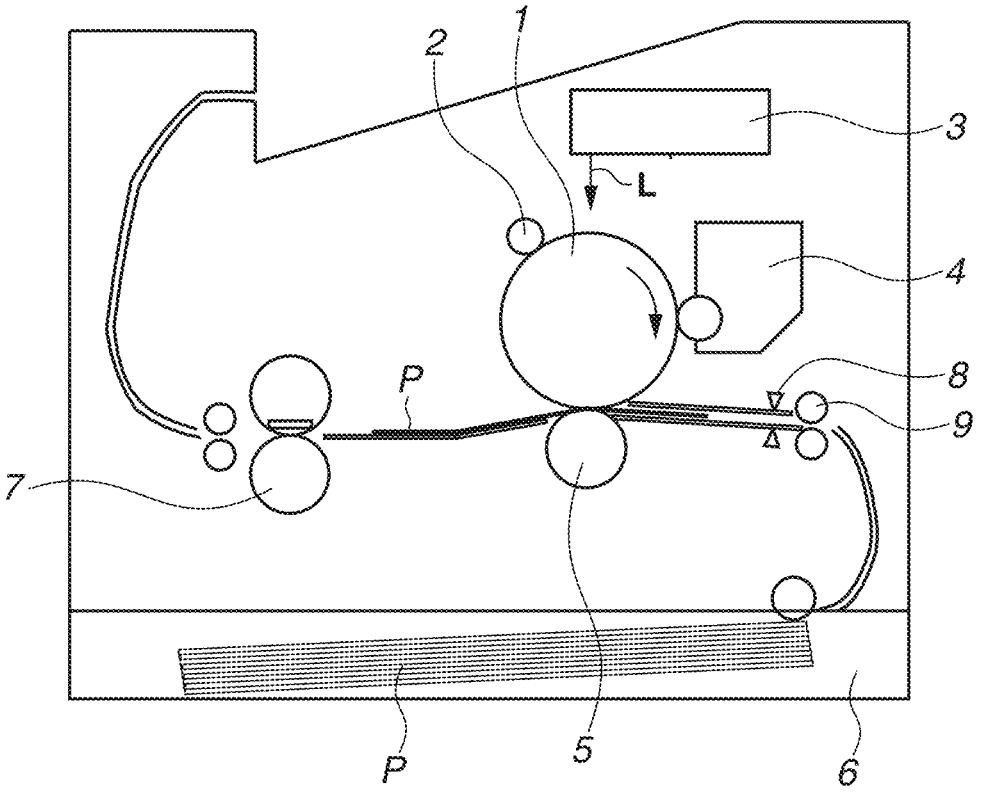
FIG. 1 is a schematic sectional view of an image forming apparatus according to a first exemplary embodiment.

In the following description, a first exemplary embodiment will be described. FIG. 1 is a schematic configuration diagram illustrating a laser beam printer (hereinafter, referred to as a printer) as an image forming apparatus according to the first exemplary embodiment. A photosensitive drum 1 is driven to rotate in the direction of the arrow. A surface of the photosensitive drum 1 is uniformly charged by a charging roller 2 serving as a charging device. The photosensitive drum 1 is then subjected to scanning exposure by a laser scanner 3 using a laser beam L which is ON/OFF controlled according to image information, whereby an electrostatic latent image is formed. A developing device 4 develops a toner image on the photosensitive drum 1 by causing toner to adhere to the electrostatic latent image. Subsequently, at a transfer nip portion, which is a pressure contact portion between a transfer roller 5 and the photosensitive drum 1, the toner image formed on the photosensitive drum 1 is transferred to a recording material P, i.e., a material to be heated, conveyed from a sheet feed cassette 6 at a predetermined timing. At that time, a top sensor 8 detects a leading edge of the recording material P conveyed by a conveyance roller 9 to adjust timing so that an image forming position of the toner image on the photosensitive drum 1 coincides with a write start position on the leading edge of the recording material P. The recording material P conveyed to the transfer nip portion at a predetermined timing is pinched and conveyed by the photosensitive drum 1 and the transfer roller 5 with a constant pressure. The recording material P to which the toner image is transferred is conveyed to a fixing device 7. The fixing device 7 heats and fixes the toner image to the recording material P. The recording material P is then discharged onto a discharge tray.

Figure 2:
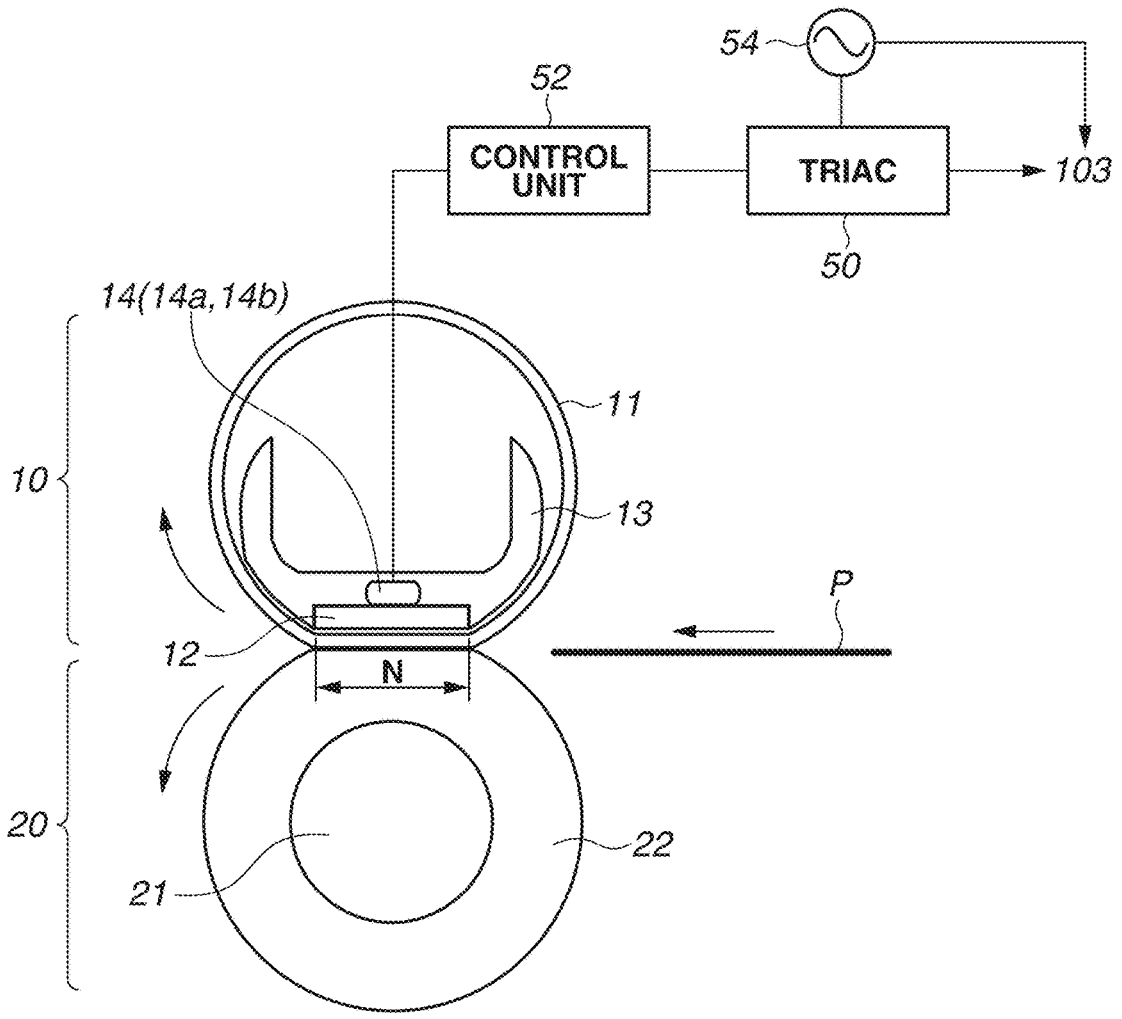
FIG. 2 is a schematic sectional view of a fixing device according to the first exemplary embodiment.

Next, the fixing device 7 according to the present exemplary embodiment will be described. FIG. 2 is a sectional view of the fixing device 7. The fixing device 7 includes a cylindrical film 11, a heater 12 which makes contact with an inner surface of the film 11, and a pressure roller 20 which forms a fixing nip portion N with the heater 12 via the film 11.

The film 11 serving as a fixing member includes a base layer and a release layer which is formed on the external surface of the base layer. The base layer is made of a heat resistant resin such as polyimide, polyamide-imide, and polyetheretherketone (PEEK). In the present exemplary embodiment, a 65-μm-thick heat resistant resin of polyimide is used. The release layer is formed with a coating of any one or a mixture of heat resistant resins having favorable releasability. Examples include fluorine resins such as polytetrafluoroethylene (PTFE), perfluoroalkoxy (PFA), and fluorinated ethylene propylene (FEP), and silicone resins. In the present exemplary embodiment, as the release layer, a 15-μm-thick coating of fluorine resin of PFA is used. The film 11 of the present exemplary embodiment has a longitudinal length of 240 mm, which is intended to allow passing of a sheet of up to Letter size (216 mm in width), and an outer diameter of 24 mm.

A film guide 13 serves as a guide member when the film 11 rotates. The film 11 is loosely fitted to the film guide 13. In the present exemplary embodiment, the film guide 13 also has a role of supporting a surface of the heater 12, opposite to the surface where the heater 12 makes contact with the film 11. The film guide 13 is made of a heat resistant resin such as a liquid crystal polymer, phenol resin, polyphenylene sulfide (PPS), and PEEK.

The pressure roller 20 serving as a pressure member includes a core 21 and an elastic layer 22 which is formed on the external surface of the core 21. The core 21 is made of a material such as steel use stainless (SUS), steel use machinability (SUM), and aluminum (Al). The elastic layer 22 is made of a heat resistant rubber such as silicon rubber and fluorine-containing rubber, or a foamed article of silicone rubber. A release layer made of a material such as PFA, PTFE, and FEP may be formed on the external surface of the elastic layer 22. The pressure roller 20 of the present exemplary embodiment has an outer diameter of 25 mm. The elastic layer 22 is made of a 3.5-mm-thick silicone rubber. The elastic layer 22 has a longitudinal length of 230 mm. The film 11, the heater 12, and the film guide 13 are unitized into a film unit 10.

The pressure roller 20 is pressed by a pressure means (not illustrated) toward the foregoing film unit 10 at both longitudinal ends. Driving force is transmitted from a driving source (not illustrated) to a gear (not illustrated) arranged on a longitudinal end of the core 21, whereby the pressure roller 20 is rotated. The film 11 is rotated by frictional force received from the pressure roller 20 at the fixing nip portion N in accordance with the rotation of the pressure roller 20.

Next, control of the heater 12 will be described with reference to FIG. 2. A main thermistor 14*a* serving as a temperature detection member is arranged at a center portion of the heater 12 in the longitudinal direction. Power supplied to the heater 12 is controlled so that the detected temperature of the main thermistor 14*a* coincides with a target temperature. Details of the power control on the heater 12 will be described. An output signal of the main thermistor 14*a* is input to a control unit 52. The control unit 52 includes a central processing unit (CPU) and memories such as a read-only memory (ROM) and a random access memory (RAM). Based on the input signal, the control unit 52 controls a current flowing through the heater 12 via a triac 50. The current flowing through the heater 12 is controlled by turning on/off an alternating-current (AC) voltage by the triac 50. A sub thermistor 14*b* is arranged on the surface of the heater 12, opposite to the surface where the heater 12 makes contact with the film 11. The sub thermistor 14*b* is arranged at a position corresponding to an end of an A4-sized recording material P when the recording material P is longitudinally conveyed. The sub thermistor 14*b* has a role of monitoring a temperature rise of a non-sheet passing area.

Figure 3:
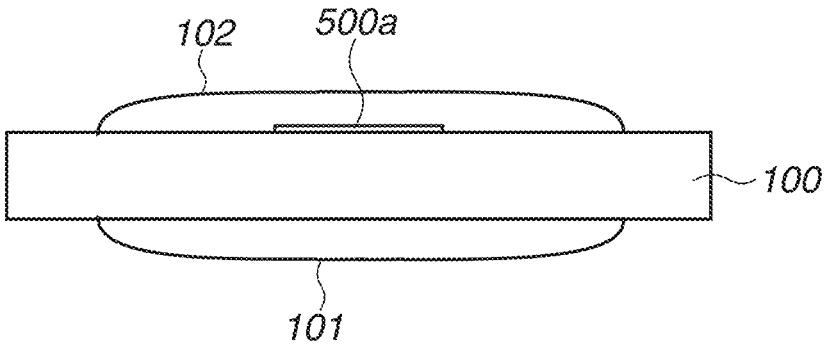
FIG. 3 is a schematic diagram illustrating a cross section of a heater according to the first exemplary embodiment.
Figure 4A:
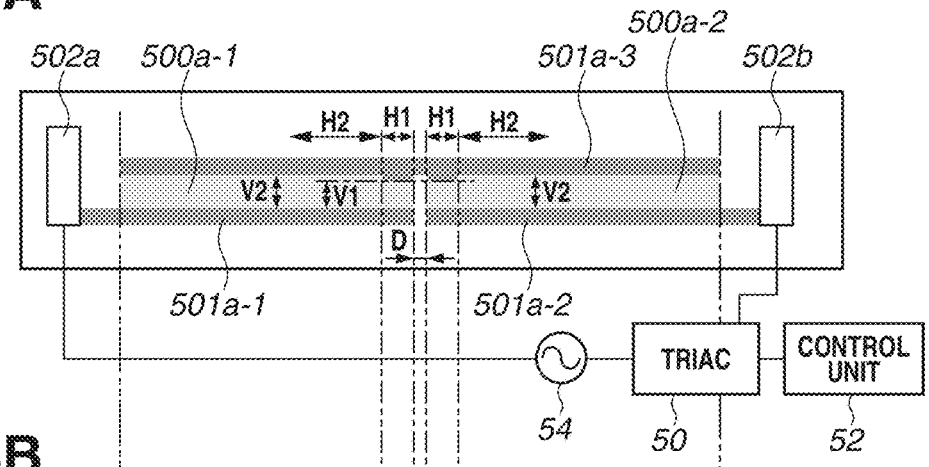
FIGS. 4A, 4B, and 4C are diagrams illustrating a schematic configuration of the heater according to the first exemplary embodiment.

A configuration of the heater 12 according to the present exemplary embodiment will be described with reference to FIGS. 3 and 4A. FIG. 3 is a cross-sectional view of the heater 12. FIG. 4A is a schematic diagram illustrating the surface of the heater 12 on the side where the heater 12 does not make contact with the inner surface of the film 11 in the present exemplary embodiment. The heater 12 includes a long, narrow substrate 100 and a heat generation resistor 500*a* formed along a longitudinal direction of the substrate 100. The heat generation resistor 500*a* is divided in two, i.e., a first heat generation resistor 500*a*-1 and a second heat generation resistor 500*a*-2 with a gap portion D therebetween in the longitudinal direction. Conductive patterns 501*a* (501*a*-1, 501*a*-2, and 501*a*-3) connected to the heat generation resistor 500*a* along the longitudinal direction are formed on the substrate 100, with the heat generation resistor 500*a* therebetween in a transverse direction.

The conductive pattern 501*a*-1 (second conductive pattern) is connected, along the longitudinal direction, to one transverse end of the heat generation resistor 500*a*-1. The conductive pattern 501*a*-2 (third conductive pattern) is connected, along the longitudinal direction, to one transverse end of the heat generation resistor 500*a*-2 on the same side as the conductive pattern 501*a*-1 is, with a gap D from the conductive pattern 501*a*-1. The conductive pattern 501*a*-3 (first conductive pattern) is connected, along the longitudinal direction, to transverse ends of the heat generation resistor 500*a*-1 and the heat generation resistor 500*a*-2 on the side opposite from where the conductive pattern 501*a*-1 is. The conductive pattern 501*a*-3 is arranged to overlap with both the conductive patterns 501*a*-1 and 501*a*-2 in the longitudinal direction. In other words, the heat generation resistors 500*a*-1 and 500*a*-2 are electrically connected in series by the conductive patterns 501*a*.

If a voltage is applied between electrical contact portions 502*a* and 502*b*, a current flows through each of the heat generation resistors 500*a*-1 and 500*a*-2 in the transverse direction (conveyance direction of the recording material P) and the heat generation resistors 500*a*-1 and 500*a*-2 generate heat. In the present exemplary embodiment, the gap portion D has a width of 0.7 mm.

The substrate 100 is made of a ceramic material such as $Al_2O_3$ (aluminum oxide) and AlN (aluminum nitride). In the present exemplary embodiment, the substrate 100 is made of $Al_2O_3$ with a size of 10 mm in width, 270 mm in longitudinal length, and 1 mm in thickness. The heat generation resistor 500*a* is made of components including a conducting agent mainly containing $RuO_2$ (ruthenium oxide), and glass. Other than the heat generation resistor 500*a*, the conductive patterns 501*a* and the electrical contact portions 502*a* and 502*b* are formed on the substrate 100 by screen printing with a thickness of approximately 10 μm. The heat generation resistor 500*a* used in the present exemplary embodiment has a sheet resistance of 500Ω/□ and a PTC characteristic (positive resistance-temperature characteristic) with a temperature coefficient of resistance (hereinafter, referred to as TCR) of 1400 ppm/° C. The value of the sheet resistance is for a thickness of 10 μm.

A protective layer 101 illustrated in FIG. 3 is formed on the surface of the heater 12 where the heater 12 makes contact with the film 11. The protective layer 101 reduces wear of the film 11. A protective layer 102 is formed on the heat generation resistor 500*a* of the heater 12. The protective layers 101 and 102 each are a 65-μm-thick glass coating layer for ensuring wear resistance and pressure resistance.

Next, a characteristic configuration of the heater 12 according to the present exemplary embodiment will be described. The heat generation resistors 500*a*-1 and 500*a*-2 each have a width V1 in the transverse direction in each of areas H1 (first areas) adjacent to the gap portion D. The width V1 is configured to be smaller than a width V2 in each of areas H2 (second areas) that is farther from the gap portion D than the area H1 is, and adjacent to the area H1. In the present exemplary embodiment, V1 is 0.86 mm, V2 is 1.0 mm, and a longitudinal length of the area H1 is 2.5 mm.

Figure 4B:
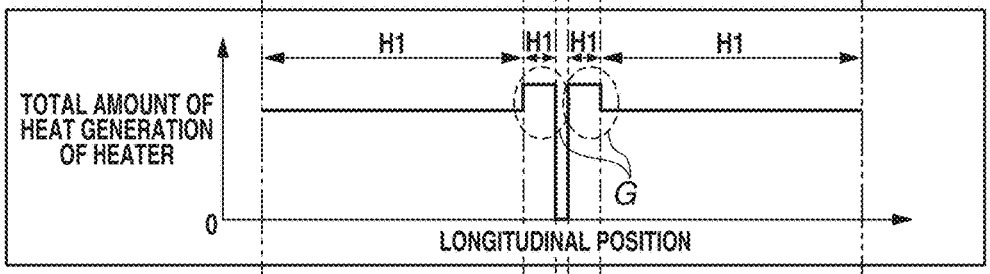

An effect of the present exemplary embodiment will be described with reference to FIGS. 4B and 4C. FIG. 4B illustrates a longitudinal distribution of the amount of heat generation by the heater 12 used in the present exemplary embodiment. The gap portion D where the heat generation resistor 500*a* is not arranged does not generate heat. The amount of heat generation per unit length of the area H1 (high heat generation portion G) in each of the heat generation resistors 500*a*-1 and 500*a*-2 is 30% greater than that of the area H2. The reason is that the areas H1 have a resistance lower than that of the area H2 in the transverse direction.

Figure 4C:
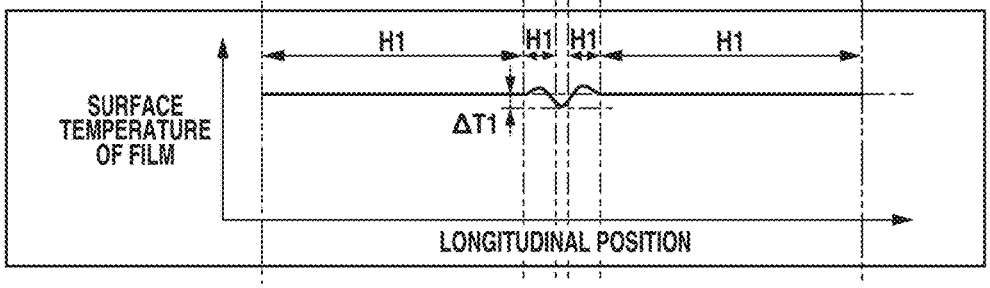

FIG. 4C illustrates a measurement result of the surface temperature of the film 11 in the longitudinal direction when the fixing device 7 using the heater 12 according to the present exemplary embodiment is left to reach room temperature and then activated to perform fixing processing on one sheet of recording material P. The longitudinal temperature distribution on the surface of the film 11 is almost uniform. The average temperature in an area not corresponding to the gap portion D was 160° C. The amount of temperature drop ΔT1 in an area corresponding to the gap portion D was 3.3° C. The amount of temperature drop ΔT1 in the area of the film 11 corresponding to the gap portion D is suppressed to be small because the heat in the areas H1 where the amount of heat generation is large flows into the gap portion D so that the temperature drop is suppressed in the gap portion D. In other words, temperature variation of the heater 12 in the longitudinal direction is suppressed by the heater 12 itself. Fixability in the case of using the heater 12 according to the present exemplary embodiment was evaluated by printing a whole-surface solid image, i.e., an image such that toner is applied to an entire surface of a recording material P. The image printed on a recording material P was evaluated under an evaluation condition in which the fixing device 7 is activated immediately after having been left to reach room temperature. As a result, the occurrence of a fixing failure was not observed in any area of the recording material P, including the gap portion D.

Figure 5A:
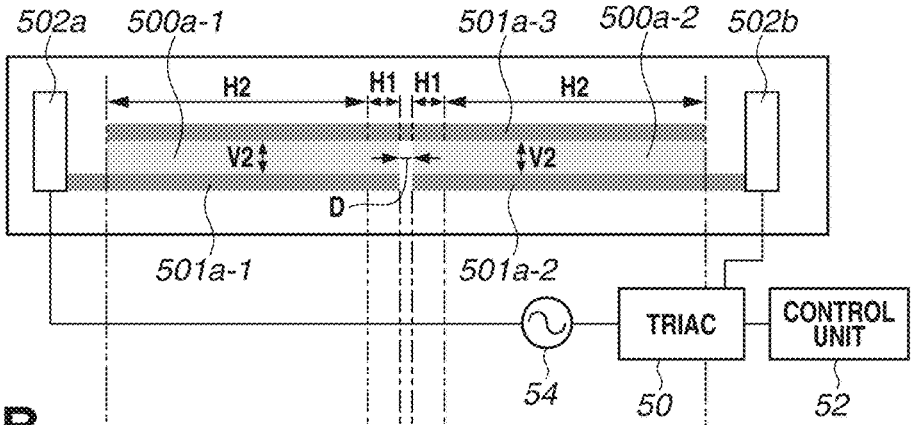
FIGS. 5A, 5B, and 5C are diagrams illustrating a schematic configuration of a heater according to a comparative example of the first exemplary embodiment.
Figure 5B:
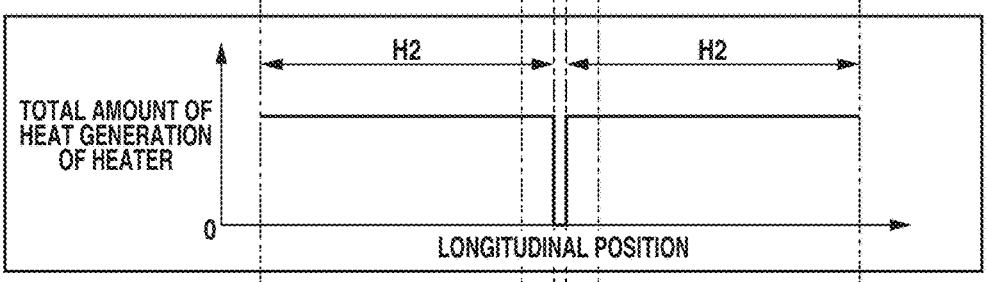
Figure 5C:
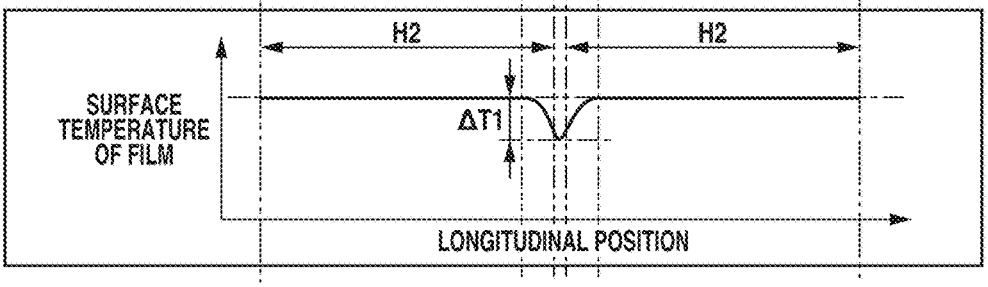

A configuration of a heater according to a comparative example of the present exemplary embodiment will be described with reference to FIGS. 5A to 5C. A difference between the configuration of the heater of the comparative example and that of the heater 12 of the present exemplary embodiment is that, as illustrated in FIG. 5A, the heat generation resistor 500*a* of the heater according to the comparative example has the same width V2 in the area H1 as in the area H2, and the high heat generation portions G are not formed. FIG. 5B illustrates a longitudinal distribution of the amount of heat generation of the heater according to the comparative example. The area of the gap portion D where there is no heat generation resistor does not generate heat. In the areas other than the gap portion D, the amount of heat generation is uniform in the longitudinal direction. FIG. 5C illustrates a distribution of the surface temperature of the film 11 in the case of using the heater of the comparative example, measured under the same condition as with the heater 12 according to the present exemplary embodiment. The temperature distribution on the surface of the film 11 drops significantly in the position corresponding to the gap portion D. The amount of temperature drop ΔT1 of the film 11 in the position corresponding to the gap portion D with respect to the average temperature value of 160° C. in the areas other than the gap portion D was 12.3° C. When a whole-surface solid image was printed, a fixing failure of approximately 2.0 mm in width occurred in the area corresponding to the gap portion D.

As described above, the heater 12 according to the present exemplary embodiment includes a plurality of longitudinally-divided conductive patterns connected to a heat generation resistor, which enables suppression of temperature variation in the longitudinal direction.

Next, first and second modifications of the present exemplary embodiment will be described with reference to FIG.

Figure 6:
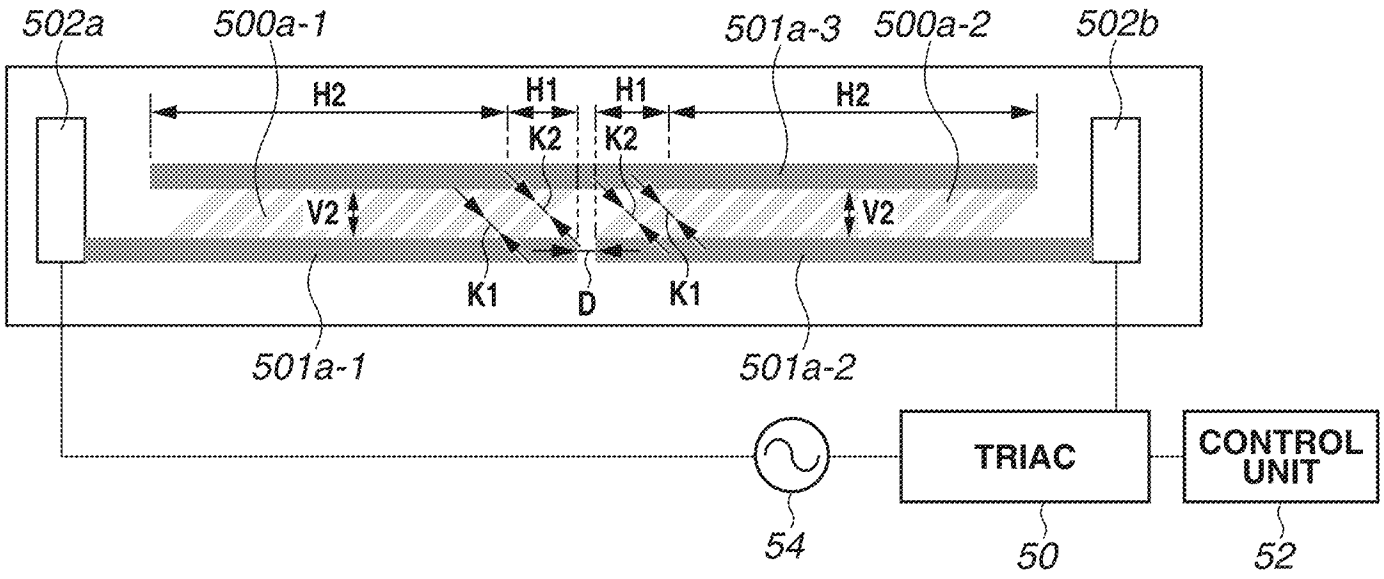
FIG. 6 is a diagram illustrating a schematic configuration of a heater according to a first modification of the first exemplary embodiment.
Figures 7A, 7B:
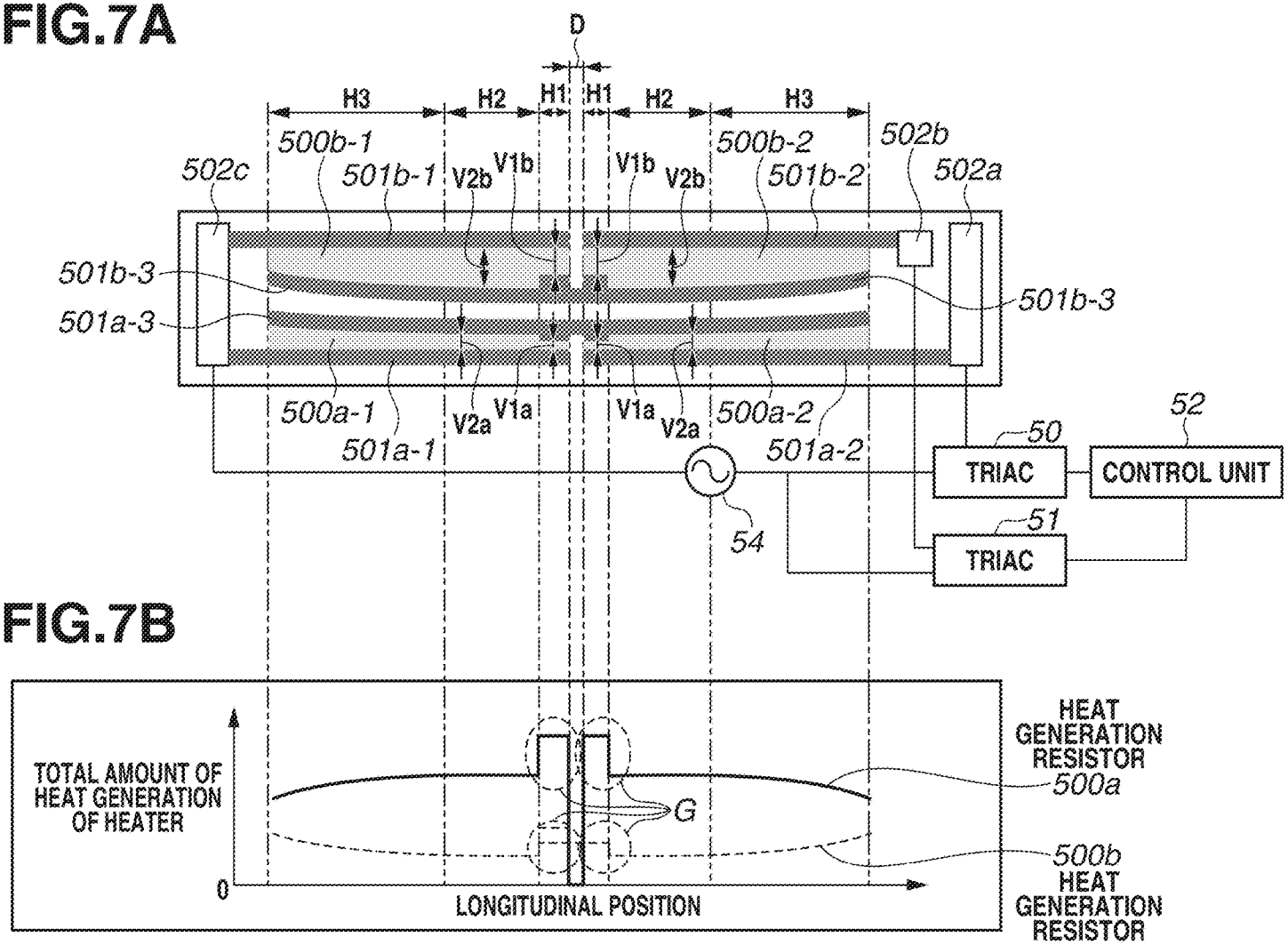
FIGS. 7A and 7B are diagrams illustrating a schematic configuration of a heater according to a second modification of the first exemplary embodiment.

6 and FIGS. 7A and 7B, respectively. FIG. 6 illustrates the first modification. As compared to the configuration of the present exemplary embodiment, the first modification has a configuration in such a manner that the heat generation resistor is intermittently arranged in a thinned-out pattern and the resulting heat generation resistors are connected to the conductive patterns 501*a* in parallel. Reducing the area of the heat generation resistor allows the use of a paste material having a low sheet resistance in the heat generation resistor and the selection of a heat generation resistor with a higher PTC characteristic. Each of the heat generation resistors connected in parallel is arranged obliquely with respect to the transverse direction so that the amount of heat generation becomes uniform in the longitudinal direction. The width of the heat generation resistor near the gap portion D is made greater than in other heat generation blocks (K2>K1) so that high heat generation portions G can be provided.

FIG. 7A illustrates a heater according to the second modification of the present exemplary embodiment. The heater of the second modification includes a first heat generation segment including a heat generation resistor 500*a* (500*a*-1 and 500*a*-2) and conductive patterns 501*a* (501*a*-1, 501*a*-2, and 501*a*-3). The heater of the second modification further includes a second heat generation segment including a heat generation resistor 500*b* (500*b*-1 and 500*b*-2) and conductive patterns 501*b* (501*b*-1, 501*b*-2, and 501*b*-3). The first and second heat generation segments are arranged next to each other in the transverse direction of the substrate 100. The heat generation resistors 500*a* and 500*b* can be independently supplied with power and controlled by using triacs 50 and 51 connected thereto, respectively. The way the heat generation resistor is divided and the way the conductive patterns are connected to the heat generation resistor in each of the first and second heat generation segments are similar to the configuration of the heater 12 illustrated in FIG. 4A. A description thereof will thus be omitted.

In the second modification, the heat generation resistors 500*a*-1 and 500*a*-2 each have a width V1*a* in each of first areas H1 adjacent to a gap portion D therebetween. The width V1*a* is configured to be smaller than a width V2*a* in each of second areas H2 that is farther from the gap portion D than the first area H1 is, and adjacent to the first area H1. In the second modification, the heat generation resistors 500*b*-1 and 500*b*-2 each have a width V1*b* in each of first areas H1 adjacent to a gap portion D therebetween. The width V1*b* is configured to be greater than a width V2*b* in each of second areas H2 that is farther from the gap portion D than the first area H1 is, and adjacent to the first area H1. In the second modification, the gap portion D between the heat generation resistors 500*a*-1 and 500*a*-2 and the gap portion D between the heat generation resistors 500*b*-1 and 500*b*-2 are arranged in the same longitudinal position. Further, in the second modification, a gap D between the conductive patterns 501*a*-1 and 501*a*-2 and a gap D between the conductive patterns 501*b*-1 and 501*b*-2 are arranged in the same longitudinal position.

The heater illustrated in FIG. 7A differs from that of the first exemplary embodiment in including areas where the transverse width of the heat generation resistor 500*a* decreases from a longitudinal end toward a center portion of the substrate 100 (areas H3 to H1). Another difference from the first exemplary embodiment lies in including areas where the transverse width of the heat generation resistor 500*b* increases from a longitudinal end toward a center portion of the substrate 100 (areas H3 to H1).

In the first heat generation segment, the amount of heat generation is greater in the center portion than at the longitudinal ends. In the second heat generation segment, the amount of heat generation is greater at the longitudinal ends than in the center portion. Such first and second heat generation segments can be independently controlled and combined to form a heat generation distribution according to the size (width) of a recording material P and suppress a temperature rise of a non-sheet passing area.

As described above, according to the second modification, the heater includes a plurality of heat generation segments, each of which includes a plurality of longitudinally-divided conductive patterns connected to a heat generation resistor, arranged in the transverse direction. Even with such a heater, temperature variation in the longitudinal direction can be suppressed.

In the present exemplary embodiment and the modifications, the heat generation resistor is divided into two. However, the number of division may be greater than two. Further, in the present exemplary embodiment, the high heat generation portions G are provided in the adjacent areas longitudinally on both sides of the gap portion D between the divided heat generation resistors. However, a high heat generation portion may be provided in either one of the adjacent areas. The high heat generation portions G according to the present exemplary embodiment and the modifications are configured to increase the amount of heat generation using the heat generation resistor having the reduced transverse width. However, the heat generation resistor may have another configuration such as an increased thickness. In the present exemplary embodiment and the modifications, the heat generation resistors is longitudinally divided according to the dividing position of the conductive pattern. However, the heat generation resistor may not be longitudinally divided, and only the conductive pattern may be divided. That is because, in the heater including divided conductive patterns, a current does not flow through the gap between the divided conductive patterns, thereby decreasing the amount of heat generation therein, even if the heat generation is continuously arranged without being divided. The configurations of the present exemplary embodiment and the modifications are thus applicable.

Figure 8A:
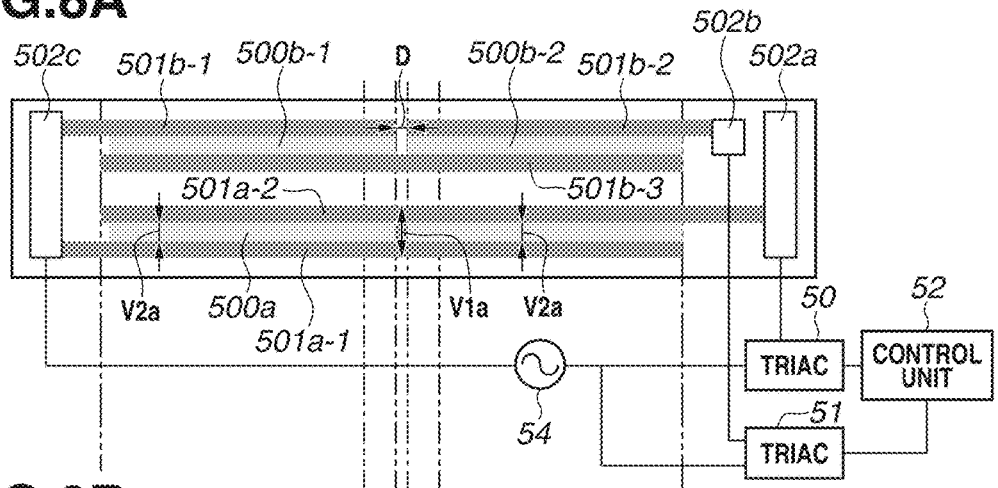
FIGS. 8A, 8B, and 8C are diagrams illustrating a schematic configuration of a heater according to a second exemplary embodiment.

A second exemplary embodiment of the present invention will be described. The present exemplary embodiment differs from the first exemplary embodiment only in the pattern of the heater 12. A description of configurations similar to those of the first exemplary embodiment other than the pattern of the heater 12 will thus be omitted. FIG. 8A is a schematic plan view of a surface of the heater 12 according to the present exemplary embodiment, opposite to the surface where the heater 12 makes contact with the film 11. The heater 12 according to the present exemplary embodiment includes a first heat generation segment including a heat generation resistor 500*a* and conductive patterns 501*a* (501*a*-1 and 501*a*-2) on the substrate 100. The heater 12 further includes a second heat generation segment including a heat generation resistor 500*b* (500*b*-1 and 500*b*-2) and conductive patterns 501*b* (501*b*-1, 501*b*-2, and 501*b*-3) on the substrate 100. Power supplied to the first and second heat generation segments can be independently controlled by using the triacs 50 and 51, respectively.

The first heat generation segment will be described. The heat generation resistor 500*a* and each of the conductive patterns 501*a*-1 and 501*a*-2 are not divided in the longitudinal direction. The conductive pattern 501*a*-1 is connected, along the longitudinal direction, to one end of the heat generation resistor 500*a*. The conductive pattern 501*a*-2 is connected, along the longitudinal direction, to a transverse end of the heat generation resistor 500*a* opposite from where the conductive pattern 501*a*-1 is. If a voltage is applied between electrodes 502*a* and 502*c*, a current flows through the heat generation resistor 500*a* in the transverse direction (conveyance direction of a recording material P) and the heat generation resistor 500*a* generates heat.

The second heat generation segment will be described. The conductive pattern 501*b*-1 (second conductive pattern) is connected, along the longitudinal direction, to one transverse end of the heat generation resistor 500*b*-1. The conductive pattern 501*b*-2 (third conductive pattern) is connected, along the longitudinal direction, to the transverse end of the heat generation resistor 500*b*-2 on the same side as the conductive pattern 501*b*-1 is, with a gap portion D from the conductive pattern 501*b*-1. The conductive patterns 501*b*-3 (first conductive pattern) is connected, along the longitudinal direction, to transverse ends of the heat generation resistor 500*b*-1 and the heat generation resistor 500*b*-2 on the side opposite from where the conductive pattern 501*b*-1 is. When seen in the conveyance direction of a recording material P, the conductive pattern 501*b*-3 is arranged to overlap with both the conductive patterns 501*b*-1 and 501*b*-2 in the longitudinal direction. In other words, the heat generation resistors 500*b*-1 and 500*b*-2 are electrically connected in series by the conductive patterns 501*b*. If a voltage is applied between an electrical contact portion 502*b* and the electrical contact portion 502*c*, a current flows through each of the heat generation resistors 500*b*-1 and 500*b*-2 in the transverse direction (conveyance direction of a recording material P) and the heat generation resistors 500*b*-1 and 500*b*-2 generate heat.

In the present exemplary embodiment, the heat generation resistor 500*a* has a width V1*a* in the transverse direction in an area (first area) overlapping with the gap portion D between the heat generation resistors 500*b*-1 and 500*b*-2 in the longitudinal direction. The width V1*a* is smaller than a width V2*a* in each of areas (second areas) not overlapping with the gap portion D. The width V1*a* of the first area of the heat generation resistor 500*a* in the transverse direction is 0.4 mm. The width V2*a* of the second area is 1.0 mm. The first area has a longitudinal length of 0.7 mm. The amount of heat generation per unit length of the first area is 20% greater than that of the second area. The heat generation resistor 500*b* has a sheet resistance of 500Ω/□, and has a PTC characteristic with TCR of 1400 ppm/° C. The heat generation resistor 500*a* has a sheet resistance of 3000Ω/□, and PTC characteristic with TCR of 500 ppm/° C. The first heat generation resistor 500*a* is provided with a high heat generation portion G to suppress a drop in the amount of heat generation in the gap portion D of the second heat generation segment. Thus, the total amount of heat generation of the first heat generation segment is smaller than that of the second heat generation segment. The heat generation resistor 500*a* is thus made of a resistive paste material having a higher sheet resistance and lower TCR than those of the heat generation resistor 500*b*.

Figure 8B:
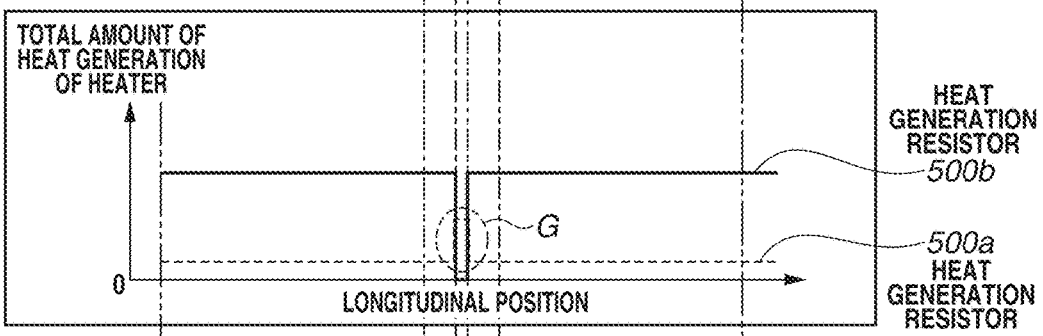

FIG. 8B illustrates a longitudinal distribution of the amount of heat generation by the heater 12 according to the present exemplary embodiment. The gap portion D of the second heat generation segment does not generate heat. The amount of heat generation of the first heat generation segment in the first area (H1) overlapping with the gap portion D is greater than in the other areas, whereby a high heat generation portion G is configured.

Figure 8C:
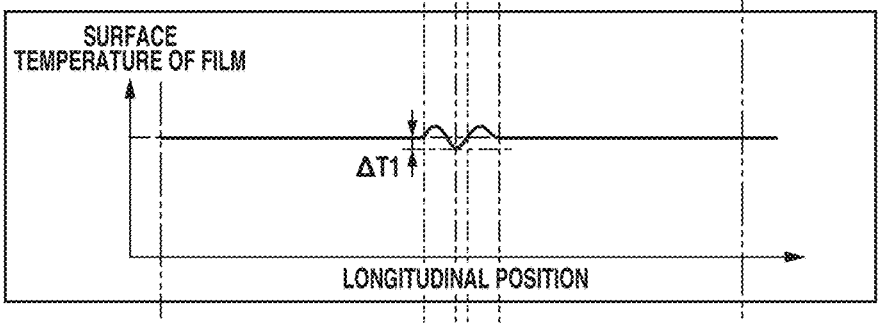

FIG. 8C illustrates a longitudinal distribution of the surface temperature of the film 11 measured by a method similar to that of the first exemplary embodiment. The longitudinal distribution of the surface temperature of the film 11 is almost uniform. The average temperature in the areas of the film 11 not corresponding to the gap portion D was 160° C. The amount of temperature drop ΔT1 in the area corresponding to the gap portion D was 3.1° C. A whole-surface solid image was printed by using the heater of the present exemplary embodiment under the same condition as in the first exemplary embodiment. As a result, the occurrence of a fixing failure was not observed in any of the areas of the recording material P, including the gap portion D.

As described above, the heater 12 of the present exemplary embodiment includes a plurality of longitudinally divided conductive patterns connected to a heat generation resistor, which enables suppression of temperature variation in the longitudinal direction.

The high heat generation portion G according to the present exemplary embodiment is configured to increase the amount of heat generation by reducing the transverse width of the heat generation resistor 500*a*. However, the heat generation resistor 500*a* may have another configuration such as an increased thickness. In the present exemplary embodiment, the heat generation resistor 500*b* is longitudinally divided according to the dividing position and the width of the conductive patterns 501*b*. However, the heat generation resistor 500*b* may be configured to not be longitudinally divided, and only the conductive patterns 501*b* may be divided.

A third exemplary embodiment of the present invention will be described. The present exemplary embodiment differs from the first exemplary embodiment only in the pattern of the heater 12. A description of configurations similar to those of the first exemplary embodiment other than the pattern of the heater 12 will thus be omitted.

Figure 9A:
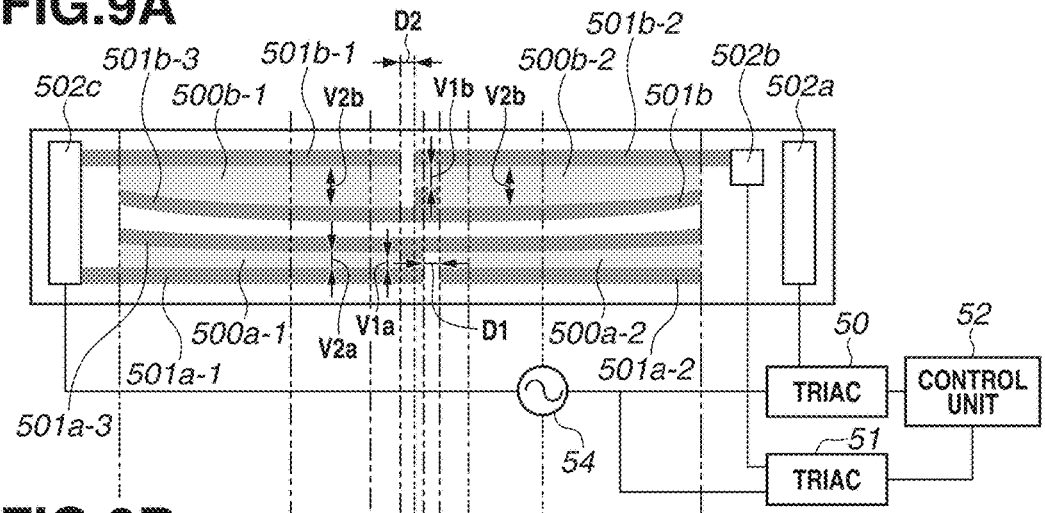
FIGS. 9A, 9B, and 9C are diagrams illustrating a schematic configuration of a heater according to a third exemplary embodiment.

The heater 12 according to the present exemplary embodiment has a similar configuration to that of the second modification of the first exemplary embodiment illustrated in FIG. 7A except in the aspects described below. A description of the similar configuration will be omitted. FIG. 9A is a schematic diagram illustrating a surface of the heater 12 according to the present exemplary embodiment, opposite from the surface where the heater 12 makes contact with the inner surface of the film 11.

A first difference between the configuration of the present exemplary embodiment and that of the second modification of the first exemplary embodiment is that a gap D1 of the heat generation resistor 500*a* in the first heat generation segment and a gap D2 of the heat generation resistor 500*b* in the second heat generation segment do not overlap in the longitudinal direction.

A second difference lies in the configuration that a high heat generation portion G is formed in a first area of the heat generation resistor 500*a*-1 where the heat generation resistor 500*a*-1 overlaps with the gap portion D2 in the longitudinal direction. Suppose that a second area of the heat generation resistor 500*a*-1 is an area that is farther from the gap portion D2 in the longitudinal direction than the first area is, and adjoins the first area. The first area of the heat generation resistor 500*a* has a width (V1*a*) smaller than the width (V2*a*) of the second area. In the present exemplary embodiment, the first area adjoins the gap portion D1.

A third difference lies in the configuration that a high heat generation portion G is formed in a third area of the heat generation resistor 500*b*-2 where the heat generation resistor 500*b*-2 overlaps with the gap portion D1 in the longitudinal direction. Suppose that a fourth area is an area that is farther from the gap portion D1 in the longitudinal direction than the third area is, and adjoins the third area. The third area of the heat generation resistor 500*b* has a width (V1*b*) smaller than the width (V2*b*) of the fourth area. In the present exemplary embodiment, the third area adjoins the gap portion D2. In the present exemplary embodiment, the first and third areas have a longitudinal width of 0.7 mm. V1*a* is 0.7 mm. V2*a* is 1.0 mm. V1*b* is 1.1 mm. V2*b* is 1.5 mm. The amount of heat generation per unit length in the longitudinal direction of the first area of the heat generation resistor 500*a* is 25% greater than that of the second area. The amount of heat generation per unit length in the longitudinal direction of the third area of the heat generation resistor 500*b* is 20% greater than that of the fourth area.

Figure 9B:
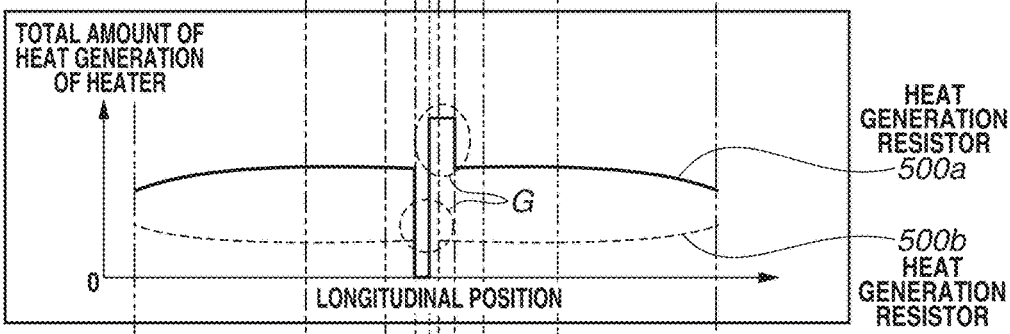
Figure 9C:
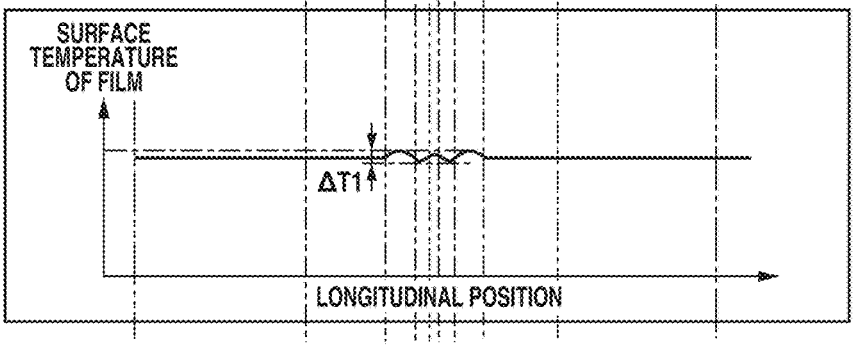

FIG. 9B illustrates a longitudinal heat generation distribution of the heater 12, showing the effect of the heater 12 according to the present exemplary embodiment. FIG. 9C illustrates a longitudinal distribution of the surface temperature of the film 11. The experiment condition is the same as in the first exemplary embodiment. As can be seen in FIG. 9B, the gap portion D1 of the first heat generation segment and the gap portion D2 of the second heat generation segment do not generate heat. The high heat generation portion G of the first heat generation segment overlaps with the gap portion D2 in the longitudinal direction, and the high heat generation portion G of the second heat generation segment overlaps with the gap portion D1. Consequently, as illustrated in FIG. 9C, the amounts of temperature drop ΔT1 in the areas of the film 11 corresponding to the gap portions D1 and D2 were 1.1° C. with respect to an average temperature of 160° C. in the areas not corresponding to the gap portions D1 and D2. A whole-surface solid image was printed by using the heater 12 according to the present exemplary embodiment under the same condition as in the first exemplary embodiment. As a result, the occurrence of a fixing failure was not observed in any of the areas of the recording material P, including the gap portions D1 and D2.

In the present exemplary embodiment, the temperature drop in the gap portion D1 of the first heat generation segment is compensated by the high heat generation portion G of the second heat generation segment. The temperature drop in the gap portion D2 of the second heat generation segment is compensated by the high heat generation portion G of the first heat generation segment.

As described above, the heater 12 according to the present exemplary embodiment includes a plurality of longitudinally-divided conductive patterns connected to a heat generation resistor, which enables suppression of temperature variation in the longitudinal direction.

Figure 10A:
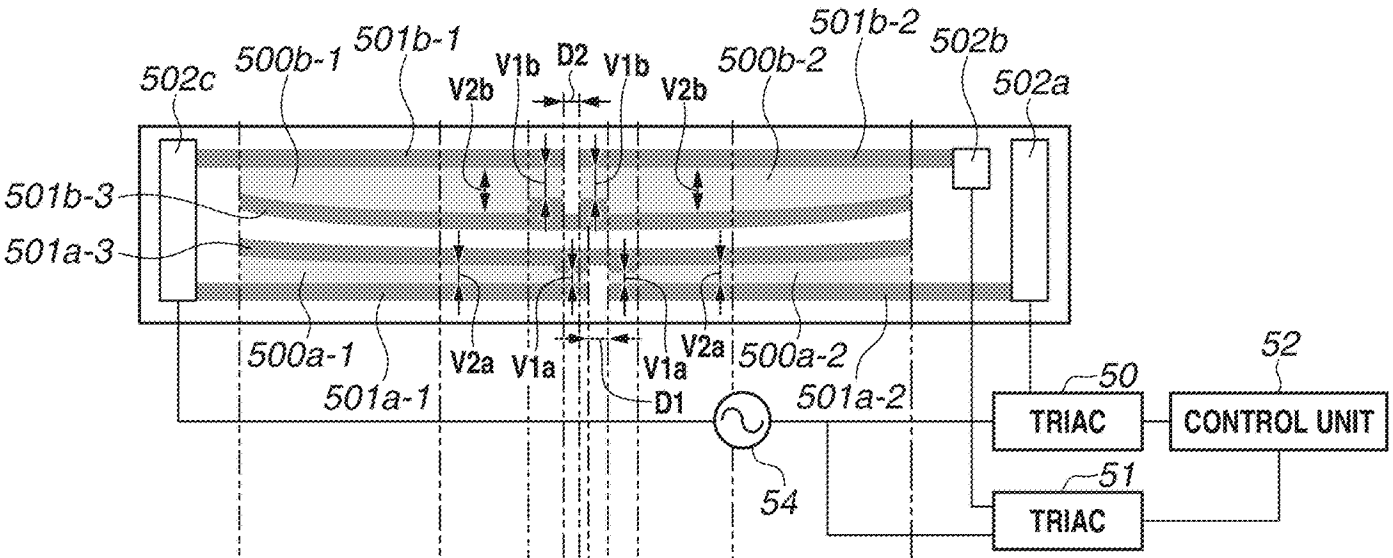
FIGS. 10A and 10B are diagrams illustrating a schematic configuration of a heater according to a modification of the third exemplary embodiment.
Figure 10B:
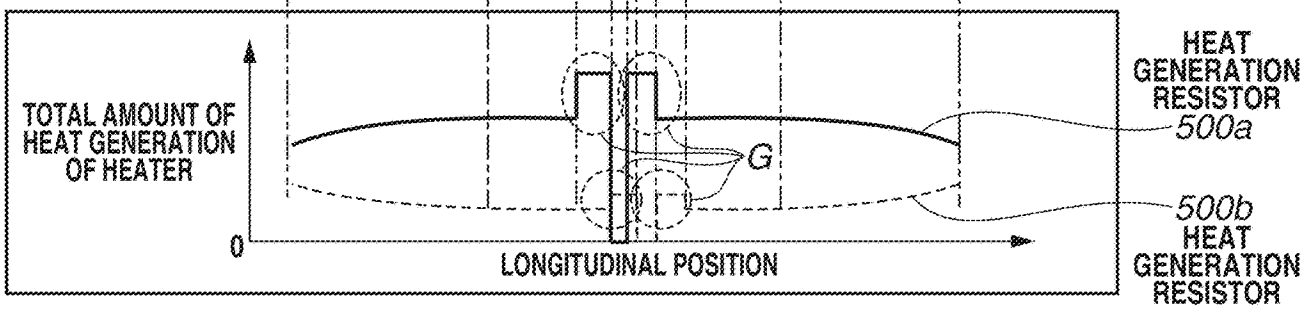

In the present exemplary embodiment, the heat generation resistor of each heat generation segment includes a high heat generation portion G only on one side of the gap portion in the longitudinal direction. However, as a modification of the present exemplary embodiment illustrated in FIGS. 10A and 10B, high heat generation portions G may be provided on both sides of the gap portion.

In the present exemplary embodiment, the high heat generation portion G is configured to increase the amount of heat generation by reducing the transverse width of the heat generation resistor. However, the heat generation resistor may have another configuration of an increased thickness. In the present exemplary embodiment, the heat generation resistors are longitudinally divided according to the dividing positions of the conductive patterns. However, the heat generation resistors may be configured to not be longitudinally divided, and only the conductive patterns may be divided.

Figures 11A, 11B, 11C:
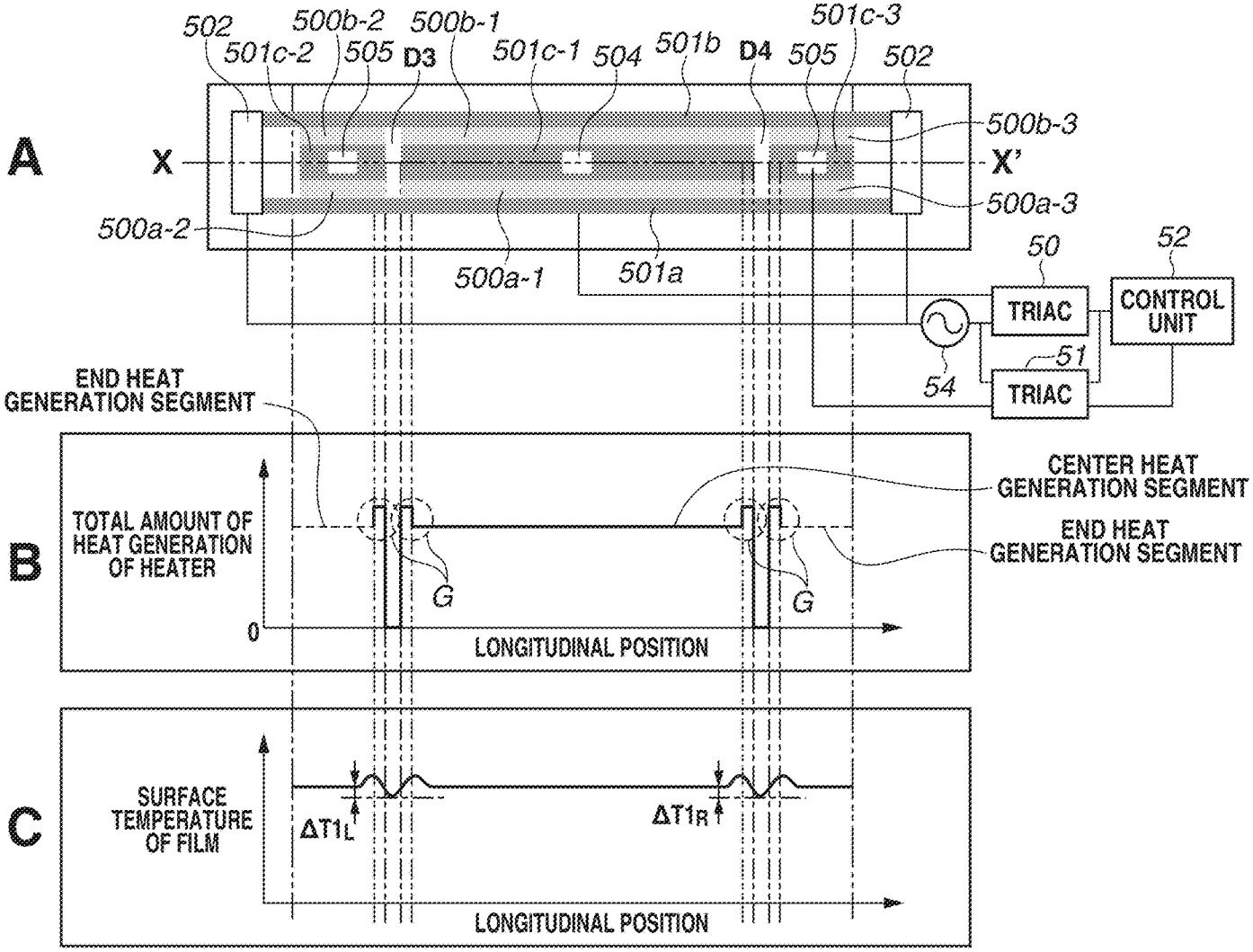
FIGS. 11A, 11B, and 11C are diagrams illustrating a schematic configuration of a heater according to a fourth exemplary embodiment.

A fourth exemplary embodiment of the present invention will be described. The present exemplary embodiment differs from the first exemplary embodiment only in the pattern of the heater 12. A description of configurations similar to those of the first exemplary embodiment other than the pattern of the heater 12 will thus be omitted. FIG. 11A is a schematic diagram illustrating a surface of the heater 12 according to the present exemplary embodiment, opposite from the surface where the heater 12 makes contact with the inner surface of the film 11. The heater 12 according to the present exemplary embodiment includes three divided conductive patterns 501*c* in the center of the substrate 100 in the transverse direction. The conductive patterns 501*c* include a conductive pattern 501*c*-1 (center conductive pattern, second conductive pattern), a conductive pattern 501*c*-2 (end conductive pattern, third conductive pattern), and a conductive pattern 501*c*-3 (end conductive pattern). The conductive patterns 501*c*-1 and 501*c*-2 have a gap D3 therebetween. The conductive patterns 501*c*-1 and 501*c*-3 have a gap D4 therebetween. The heater 12 according to the present exemplary embodiment further includes a heat generation resistor 500*a*-1 (first heat generation resistor, center heat generation resistor) and a heat generation resistor 500*b*-1 (center heat generation resistor), which are connected to the conductive pattern 501*c*-1 along the longitudinal direction while being respectively arranged on each side of the conductive pattern 501*c*-1 in the transverse direction. The heater 12 according to the present exemplary embodiment further includes a heat generation resistor 500*a*-2 (second heat generation resistor, end heat generation resistor) and a heat generation resistor 500*b*-2 (end heat generation resistor), which are connected to the conductive pattern 501*c*-2 along the longitudinal direction while being respectively arranged on each side of the conductive pattern 501*c*-2 in the transverse direction. The heater 12 according to the present exemplary embodiment further includes a heat generation resistor 500*a*-3 (third heat generation resistor) and a heat generation resistor 500*b*-3, which are connected to the conductive pattern 501*c*-3 along the longitudinal direction while being respectively arranged on each side of the conductive pattern 501*c*-3 in the transverse direction.

The heat generation resistors 500*a*-1 and 500*a*-2 have the gap D3 therebetween. The heat generation resistors 500*a*-1 and 500*a*-3 have the gap D4 therebetween. The heat generation resistors 500*b*-1 and 500*b*-2 also have the gap D3 therebetween. The heat generation resistors 500*b*-1 and 500*b*-3 also have the gap D4 therebetween.

The heater 12 according to the present exemplary embodiment includes a conductive pattern 501*a* (first conductive pattern, common conductive pattern). The conductive pattern 501*a* is connected to the heat generation resistors 500*a* (500*a*-1, 500*a*-2, and 500*a*-3) along the longitudinal direction so that the heat generation resistors 500*a* lie between the conductive pattern 501*a* and the conductive patterns 501*c* (501*c*-1, 501*c*-2, and 501*c*-3) in the transverse direction. The heater 12 according to the present exemplary embodiment further includes a conductive pattern 501*b* (common conductive pattern). The conductive pattern 501*b* is connected to the heat generation resistors 500*b* (500*b*-1, 500*b*-2, and 500*b*-3) along the longitudinal direction so that the heat generation resistors 500*b* lie between the conductive pattern 501*b* and the conductive patterns 501*c* (501*c*-1, 501*c*-2, and 501*c*-3) in the transverse direction. The conductive patterns 501*a* and 501*b* are not longitudinally divided. The heat generation resistors and the conductive patterns of the heater 12 described above are formed symmetrically with respect to a center line X-X' of the substrate 100.

The conductive pattern 501*c*-1 is provided with an electrode 504. The conductive patterns 501*c*-2 and 501*c*-3 are each provided with an electrode 505. The conductive patterns 501*a* and 501*b* are provided with electrodes 502. If a voltage is applied between each of the electrodes 502 and the electrode 504, currents flow through the heat generation resistors 500*a*-1 and 500*b*-1 in the transverse direction and the heat generation resistors 500*a*-1 and 500*b*-1 generate heat. Such a portion will hereinafter be referred to as a center heat generation segment. If a voltage is applied between each of the electrodes 502 and each of the electrodes 505, currents flow through the heat generation resistors 500*a*-2 and 500*b*-2 and the heat generation resistors 500*a*-3 and 500*b*-3 in the transverse direction and the heat generation resistors 500*a*-2 and 500*b*-2 and the heat generation resistors 500*a*-3 and 500*b*-3 generate heat. Such portions will hereinafter be referred to as end heat generation segments. Power can be independently supplied to the center heat generation segment and the end heat generation segments via triacs 50 and 51, respectively. The heat generation area of the center heat generation segment has a longitudinal length of 158 mm which corresponds to an A5 size (149 mm×210 mm), i.e., a regular size of a recording material P. The heat generation areas including the center heat generation segment and the end heat generation segments have a total longitudinal length of 225 mm which corresponds to an A4 size (210 mm×297 mm), i.e., a regular size of a recording material P.

Figure 12:
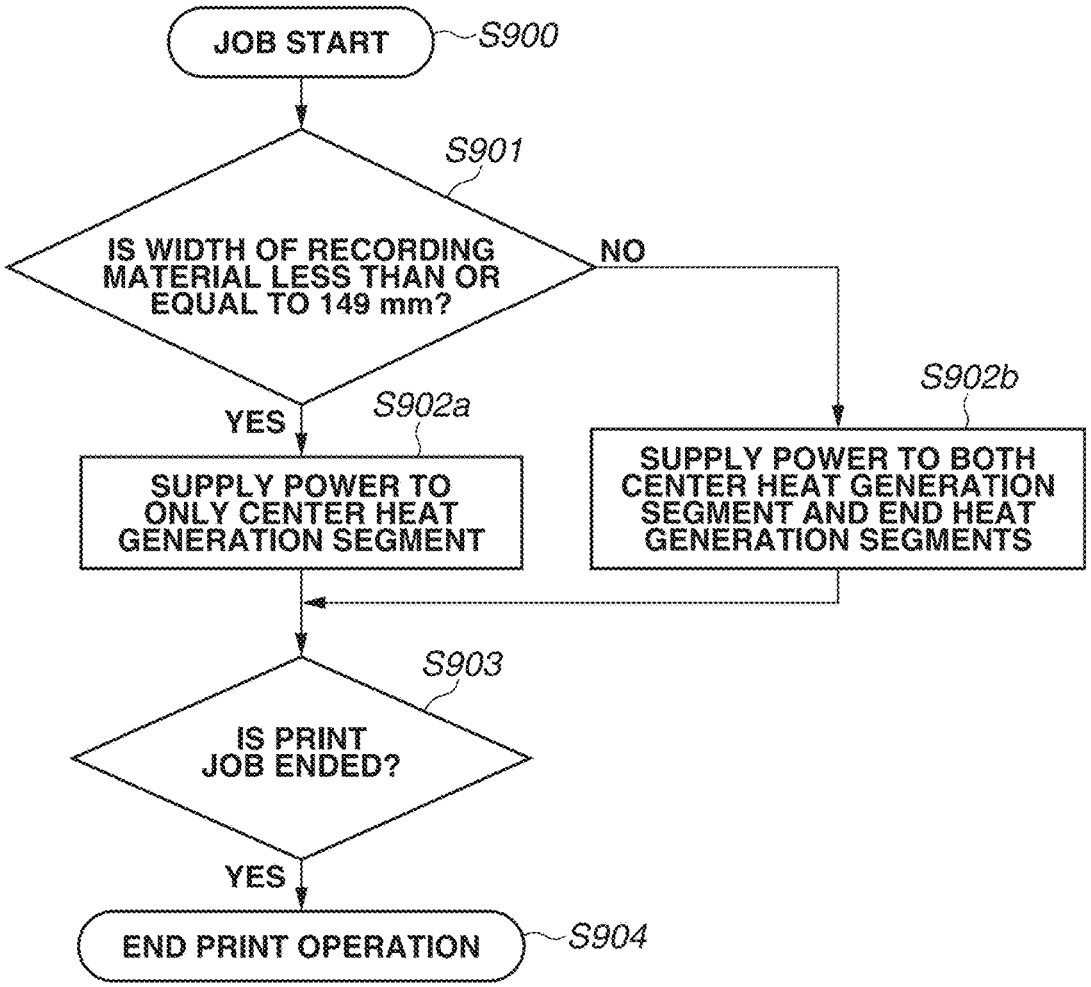
FIG. 12 is a flowchart illustrating switching of heat generation segments of the heater according to the fourth exemplary embodiment.

A control for switching the heat generation segments of the heater 12 in the fixing device 7 according to the present exemplary embodiment will be described with reference to the flowchart of FIG. 12. In step S900, the image forming apparatus receives a print job. In step S901, the control unit 52 determines whether the width of a recording material P to be used for printing is less than or equal to 149 mm. If the width is less than or equal to 149 mm (YES in step S901), then in step S902*a*, the control unit 52 supplies power to only the center heat generation segment. If the width exceeds 149 mm (NO in step S901), then in step S902*b*, the control unit 52 supplies power to both the center heat generation segment and the end heat generation segments. If the print job is ended (YES in step S903), then in step S904, the image forming apparatus ends the print operation. In such a manner, the control unit 52 performs a switching control on the heat generation segments, which enables suppression of a temperature rise of a non-sheet passing area. The configuration of the heater 12 according to the present exemplary embodiment accepts the A4 size, and thus can reduce a temperature rise of the non-sheet passing area of the A5 size.

Figure 13A:
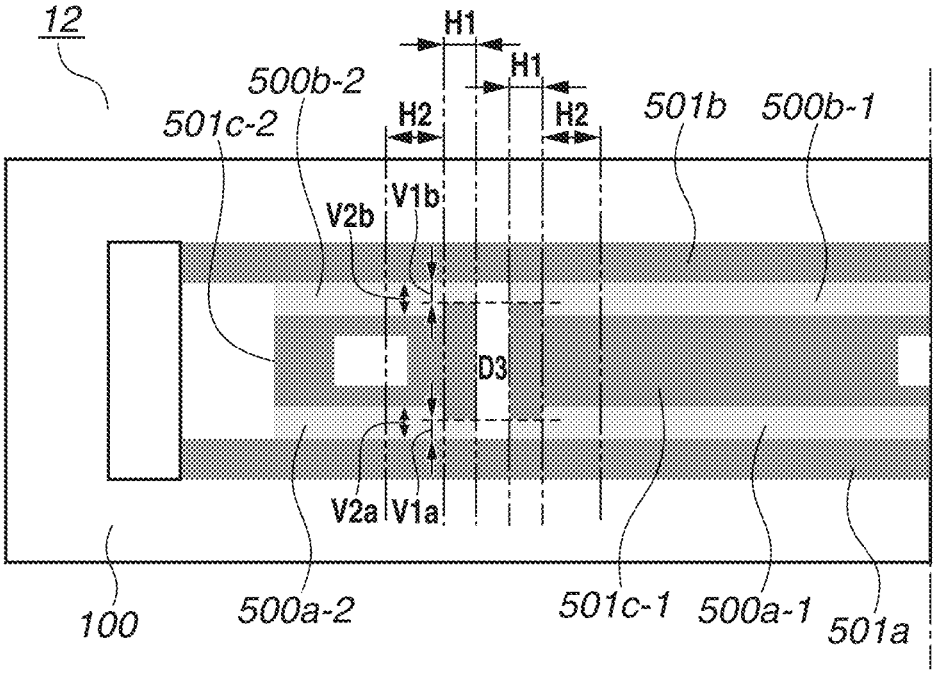
FIGS. 13A and 13B are enlarged views of the heater according to the fourth exemplary embodiment.

Next, a characteristic configuration of the present exemplary embodiment will be described with reference to FIG. 13A. FIG. 13A is an enlarged view illustrating only a half of the heater 12 according to the present exemplary embodiment illustrated in FIG. 11A on one side of the longitudinal center where there is the gap portion D3. The other half on the side of the longitudinal center where there is the gap portion D4 has a pattern symmetrical to that illustrated in FIG. 13A with respect to the center of the heater 12. A description thereof will thus be omitted.

The areas adjacent to the gap portion D3 in the longitudinal direction will be referred to as first areas (H1). The areas that are farther from the gap portion D3 in the longitudinal direction than the first areas are and adjoin the first areas will be referred to as second areas (H2). The heat generation resistors 500*a*-1 and 500*a*-2 have a width V1*a* in the transverse direction in the first areas (H1). The width V1*a* is smaller than the width V2*a* of the heat generation resistors 500*a*-1 and 500*a*-2 in the transverse direction in the second areas (H2). Similarly, the heat generation resistors 500*b*-1 and 500*b*-2 have a width V1*b* in the transverse direction in the first areas (H1). The width V1*b* is smaller than the width V2*b* of the heat generation resistors 500*b*-1 and 500*b*-2 in the transverse direction in the second areas (H2). In such a manner, the widths of the heat generation resistors are reduced to lower the resistances, whereby high heat generation portions G are formed locally near the gap portion D3. At least either one of the first areas of the heat generation resistors 500*a*-1 and 500*a*-2 may have the transverse width V1*a* smaller than the transverse width V2*b* of the second areas.

FIG. 11B illustrates a longitudinal heat generation distribution of the heater 12, showing the effect of the heater 12 of the present exemplary embodiment. FIG. 11C illustrates a longitudinal distribution of the surface temperature of the film 11. The experiment condition is the same as in the first exemplary embodiment. As can be seen in FIG. 11B, the areas of the heater 12 corresponding to the gap portions D3 and D4 do not generate heat. The amount of heat generation in the first areas (H1) provided on both longitudinal sides of the respective gap portions D3 and D4 is greater than that in the second areas (H2), whereby the high heat generation portions G are configured. As can be seen in FIG. 11C, the amounts of temperature drop $\Delta T1_L$ and $\Delta T1_R$ in the areas of the film 11 corresponding to the respective gap portions D3 and D4 were 3.4° C. with respect to an average temperature of 160° C. in the areas not corresponding to the gap portions D3 and D4. A whole-surface solid image was printed by using the heater of the present exemplary embodiment under the same condition as in the first exemplary embodiment. As a result, the occurrence of a fixing failure was not observed in any of the areas of the recording material P, including the areas corresponding to the gap portions D3 and D4.

It can be seen that with such a configuration, a drop in the amount of heat generation in the gap portions D3 and D4 of the heater 12 is compensated by the high heat generation portions G configured in the first areas, whereby temperature variation in the longitudinal direction of the heater 12 is suppressed.

Figure 14:
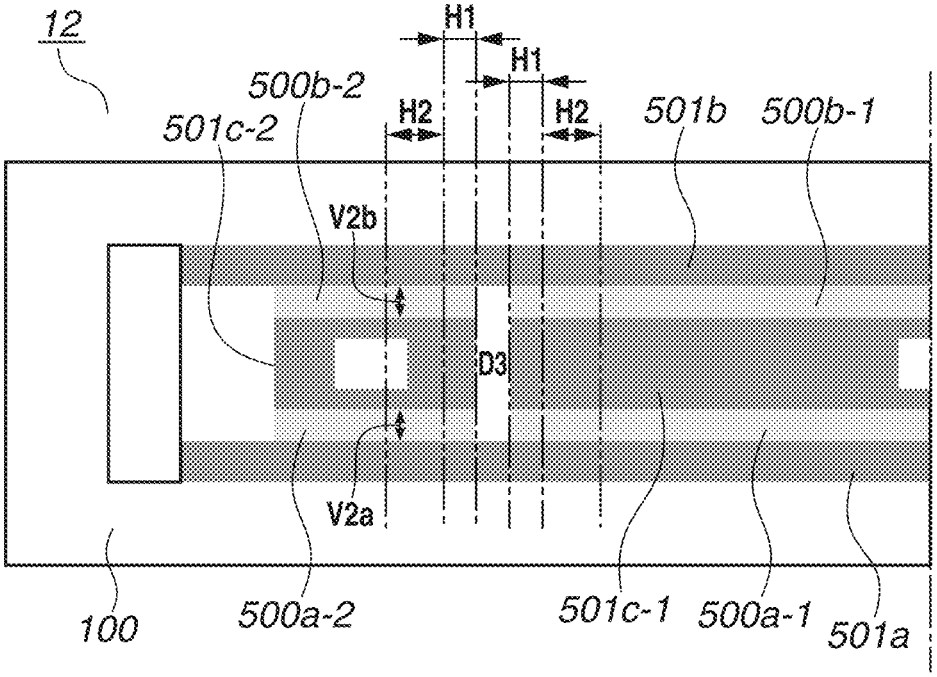
FIG. 14 is an enlarged view of a heater according to a comparative example of the fourth exemplary embodiment.

FIG. 14 illustrates an enlarged view of a half of a heater 12 on one side of the longitudinal center, as a comparative example. Unlike the heater 12 illustrated in FIG. 11A, the heater 12 of the comparative example includes no high heat generation portion G in the first portions (H1). In the heater 12 of the comparative example, the heat generation resistors 500*a*-1 and 500*a*-2 have the same width V2*b* in the first areas (H1) and the second areas (H2). The heat generation resistors 500*b*-1 and 500*b*-2 have the same width V2*b* in the first areas (H1) and the second areas (H2).

The same experiment as that of the present exemplary embodiment was performed by using the heater 12 of the comparative example to measure the amounts of temperature drop $\Delta T1_L$ and $\Delta T1_R$ in the areas of the film 11 corresponding to the gap portions D3 and D4, respectively. The measurements were 12.0° C. with respect to an average temperature of 160° C. in the areas not corresponding to the gap portions D3 and D4. A whole-surface solid image was printed by using the heater 12 of the comparative example under the same condition as in the present exemplary embodiment. As a result, fixing failures of approximately 2 mm in width occurred in the positions corresponding to the gap portions D3 and D4. The reason for the occurrence of the fixing failures is considered to be that the heater 12 of the comparative example is not able to compensate a drop in the amount of heat generation in the gap portions D3 and D4.

As described above, the heater 12 according to the present exemplary embodiment includes a plurality of longitudinally-divided conductive patterns connected to heat generation resistors, which enables suppression of temperature variation in the longitudinal direction.

Figure 13B:
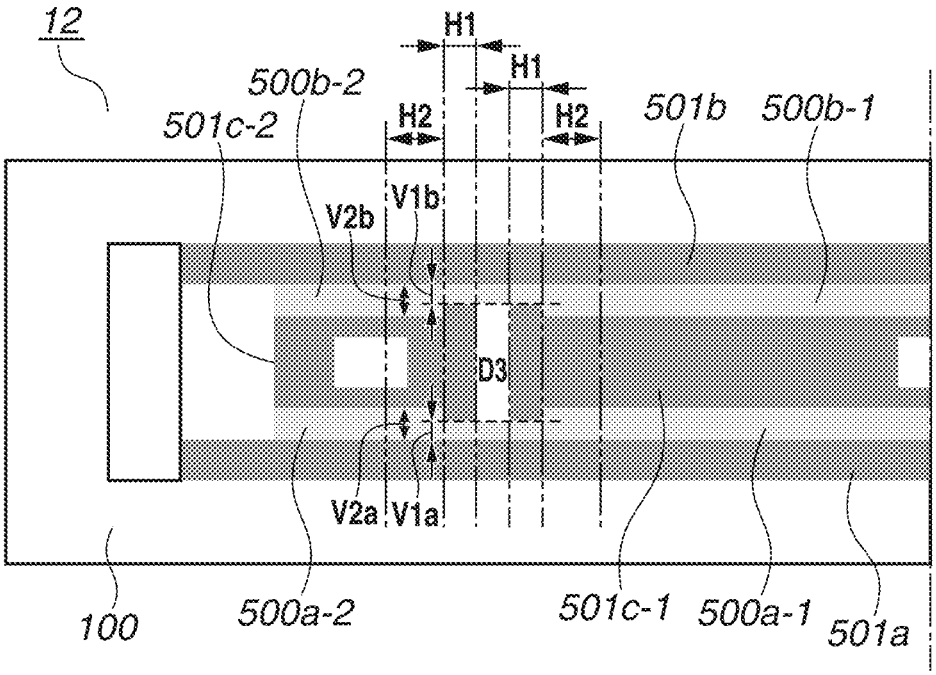

The high heat generation portions G according to the present exemplary embodiment are configured to increase the amount of heat generation by reducing the widths of the heat generation resistors in the transverse direction. However, the heat generation resistors may have another configuration such as an increased thickness. In the present exemplary embodiment, the heat generation resistors are longitudinally divided according to the dividing positions of the conductive patterns. However, as illustrated in FIG. 13B, the heat generation resistors may be configured to not be longitudinally divided, and only the conductive patterns may be divided. Even in such a case, the configuration of the present exemplary embodiment is effective.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-022676, filed Feb. 6, 2015, which is hereby incorporated by reference herein in its entirety.

What is claimed is:

1. A heater used in a fixing device, comprising:

an elongated substrate;

a first heat generation resistor formed on the substrate;

a second heat generation resistor formed on the substrate next to the first heat generation resistor in a longitudinal direction of the substrate, the first heat generation resistor and the second heat generation resistor being arranged with a gap therebetween in the longitudinal direction;

a first conductive pattern connected, along the longitudinal direction, to each one end of the first and second heat generation resistors in a transverse direction of the substrate;

a second conductive pattern formed in an area of the substrate on a side opposite to the first conductive pattern in the transverse direction across the first heat generation resistor and connected to the first heat generation resistor along the longitudinal direction, the second conductive pattern not being connected to the second heat generation resistor; and a third conductive pattern formed in an area of the substrate on a side opposite to the first conductive pattern in the transverse direction across the second heat generation resistor and connected to the second heat generation resistor along the longitudinal direction, the third conductive pattern not being connected to the second conductive pattern or the first heat generation resistor, wherein a width of the first heat generation resistors in the transverse direction in a first area of the first heat generation resistor adjacent to the gap is smaller than a width of the first heat generation resistor in the transverse direction in a second area of the first heat generation resistor, arranged adjacent to the first area, farther from the gap in the longitudinal direction than the first area.

2. The heater according to claim 1, wherein the first heat generation resistor includes an area in which the width of the first heat generation resistor in the transverse direction increases from an end toward a center portion of the substrate in the longitudinal direction.

3. The heater according to claim 1, wherein the first heat generation resistor is arranged in a center portion of the substrate in the longitudinal direction, and the second heat generation resistor is arranged on an end portion of the substrate in the longitudinal direction.

4. The heater according to claim 1, wherein the first conductive pattern is arranged on an end portion of the substrate in the transverse direction.

5. The heater according to claim 1, wherein the first and second heat generation resistors have a positive temperature characteristic.

6. A heater used in a fixing device, comprising:

an elongated substrate;

a center conductive pattern formed on a center portion of the substrate in a longitudinal direction of the substrate;

an end conductive pattern formed on an end of the substrate in the longitudinal direction, the center conductive pattern and the end conductive pattern being arranged with a gap therebetween in the longitudinal direction;

two center heat generation resistors formed to sandwich the center conductive pattern therebetween in a transverse direction of the substrate, each of the center heat generation resistors being connected to the center conductive pattern along the longitudinal direction;

two end heat generation resistors formed to sandwich the end conductive pattern therebetween in the transverse direction, each of the end heat generation resistors being connected to the end conductive pattern along the longitudinal direction; and common conductive patterns connected to both the center heat generation resistors and the end heat generation resistors at one end and the other end of the substrate in the transverse direction, respectively, each of the common conductive patterns being connected to the center heat generation resistors and the end heat generation resistors along the longitudinal direction, wherein a width of each of the end heat generation resistors in the transverse direction in a first area of the end heat generation resistors adjacent to the gap is smaller than a width of each of the end heat generation resistors in the transverse direction in a second area of the end heat generation resistors, arranged adjacent to the first area, farther from the gap in the longitudinal direction than the first area.

7. A heater used in a fixing device, comprising:

an elongated substrate;

a center conductive pattern formed on a center portion of the substrate in a longitudinal direction of the substrate;

an end conductive pattern formed on an end of the substrate in the longitudinal direction, the center conductive pattern and the end conductive pattern being arranged with a gap therebetween in the longitudinal direction;

two center heat generation resistors formed to sandwich the center conductive pattern therebetween in a transverse direction of the substrate, each of the center heat generation resistors being connected to the center conductive pattern along the longitudinal direction;

two end heat generation resistors formed to sandwich the end conductive pattern therebetween in the transverse direction, each of the end heat generation resistors being connected to the end conductive pattern along the longitudinal direction; and common conductive patterns connected to both the center heat generation resistors and the end heat generation resistors at one end and the other end of the substrate in the transverse direction, respectively, each of the common conductive patterns being connected to the center heat generation resistors and the end heat generation resistors along the longitudinal direction, wherein a width of each of the center heat generation resistors in the transverse direction in a first area of the center heat generation resistors adjacent to the gap is smaller than a width of each of the center heat generation resistors in the transverse direction in a second area of the center heat generation resistors, arranged adjacent to the first area, farther from the gap in the longitudinal direction than the first area.

8. A fixing device for fixing an image formed on a recording material onto the recording material, comprising:

a cylindrical film; and a heater configured to be in contact with an inner surface of the film, wherein the heater is the heater according to claim 1.

9. A fixing device for fixing an image formed on a recording material onto the recording material, comprising:

a cylindrical film; and a heater configured to be in contact with an inner surface of the film, wherein the heater is the heater according to claim 6.

10. A fixing device for fixing an image formed on a recording material onto the recording material, comprising:

a cylindrical film; and a heater configured to be in contact with an inner surface of the film, wherein the heater is the heater according to claim 7.

* * * * *